US005456768A

United States Patent [19]

Tomari et al.

[11] Patent Number: 5,456,768

[45] Date of Patent: Oct. 10, 1995

[54] SURFACE TREATMENT OF STAINLESS STEEL COMPONENT FOR SEMICONDUCTOR MANUFACTURING APPARATUS

[75] Inventors: Haruo Tomari; Ikuro Hashimaoto; Koji Wada, all of Kobe, Japan

[73] Assignee: Kabushiki Kaisha Kobe Seiko Sho, Kobe, Japan

[21] Appl. No.: 239,400

[22] Filed: May 6, 1994

[30] Foreign Application Priority Data

May 7, 1993 [JP] Japan ..... 5-131441

[51] Int. Cl.[6] ..... C23C 8/12

[52] U.S. Cl. ..... 148/280; 148/286

[58] Field of Search ..... 148/280, 286

[56] References Cited

U.S. PATENT DOCUMENTS 3,519,496 7/1970 Finn .

5,259,935 11/1993 Davidson ..... 148/280

FOREIGN PATENT DOCUMENTS 64-31956 2/1989 Japan .

2092621 8/1982 United Kingdom .

OTHER PUBLICATIONS

JP 05-059524 A, Pat. Abstr. JP C-1083, 14.7.93, vol. 17, No. 373 W/English Translantion.

*Primary Examiner*—Sam Silverberg

*Attorney, Agent, or Firm*—Oblon, Spivak, McClelland, Maier & Neustadt

[57] ABSTRACT

A process for surface treatment which comprises mechanically polishing the surface of a stainless steel component with abrasive grains having particle diameters of 1–10 μm to such an extent that the surface has a work-strained layer formed therein which is characterized by that X-ray diffraction by the (111) plane of austenitic iron gives the diffraction beams whose half-value width (2θ) is greater than 0.5 degree, and subsequently performing heat treatment in an atmosphere in which the partial pressure of oxygen is low, thereby forming an oxide film composed mainly of chromium oxide which has a thickness greater than 200 Å and a surface roughness $R_{max}$ smaller than 1 μm.

The surface-treated stainless steel exhibits outstanding corrosion resistance to halogen gases such as $Cl_2$, HCl, and $F_2$. It has such a smooth surface that it hardly adsorbs moisture vapor and gases. Therefore, it is suitable for use as components of semiconductor manufacturing apparatus.

8 Claims, 3 Drawing Sheets

SURFACE TREATMENT OF STAINLESS STEEL COMPONENT FOR SEMICONDUCTOR MANUFACTURING APPARATUS

BACKGROUND OF THE INVENTION

1. Field of the Invention

The present invention relates to a process for surface treatment of a stainless steel component for semiconductor manufacturing apparatus, and more particularly to a process for surface treatment to form on the surface of stainless steel a film which exhibits outstanding corrosion resistance to highly corrosive halogen gases such as HCl, $Cl_2$, and HF.

2. Description of the Prior Art

The semiconductor manufacturing technology has recently reached a level where the high integration of elements requires that interconnects be spaced with a precision of the order of submicron. Such highly integrated elements are vulnerable to foreign substances no matter how they are small. Even a minute particle or bacterium will cause a short circuit which leads to defectives. For this reason the production of semiconductors needs extremely pure water and gases. To ensure the high purity of gases, it is necessary to minimize their contamination with impurity gases (such as moisture vapor) and fine particles originating from the surface of the piping and reaction chamber.

The gas piping for semiconductor manufacturing apparatus is conventionally made of austenitic stainless steel (such as Type 304L and Type 316L) because of its good weldability and corrosion resistance. Usually, it has its surface smoothed by electropolishing so as to reduce the adsorption area and thereby to reduce the adsorption and desorption of impurity gases. There have been proposed other technologies to this end. For example, Japanese Patent Laid-open No. 87760/1989 discloses a component designed to reduce the amount of gas released from the surface by means of an amorphous oxide film which is formed by heating in an oxidative gas atmosphere after electropolishing. Japanese Patent Laid-open No. 161145/1988 discloses a stainless steel pipe in which is extremely reduced the amount of non-metallic inclusions which give off fine particles and permit the adsorption and desorption of impurities. Japanese Patent Laid-open No. 59524/1993 discloses a stainless steel component with its surface layer coated by an oxide film (20–150 Å thick) composed mainly of $Cr_2O_3$ which needs less time for baking.

The above-mentioned stainless steel components are satisfactory when used as piping for non-corrosive gases such as oxygen and nitrogen. However, their surface is subject to corrosion by highly corrosive halogen gases such as HCl, $Cl_2$, and HF, because it is as thin as 150 Å or less no matter whether it is composed mainly of $Fe_2O_3$ (which is poor in corrosion resistance) or $Cr_2O_3$ (which is superior in corrosion resistance). Corrosion products adsorb and desorb gases to lower the purity of the feed gas. In addition, corrosion products (as metal chloride) in the form of fine particles are also the source of contamination.

Consequently, the semiconductor industry, in which there is a growing tendency toward the high degree of integration, has aroused an increasing demand for the material which has outstanding corrosion resistance to halogen gases. An example of such materials is high-Ni alloy (Hastelloy) which is superior in corrosion resistance to Type 304L and Type 316L. However, it is very expensive and yet it is not completely corrosion-resistant.

SUMMARY OF THE INVENTION

The present invention was completed in view of the foregoing. It is an object of the present invention to provide a process for surface treatment to improve stainless steel in corrosion resistance to halogen gases.

The present invention is embodied in a process for surface treatment which comprises mechanically polishing the surface of a stainless steel component with abrasive grains having particle diameters of 1–10 μm to such an extent that the surface has a work-strained layer formed therein which is characterized by that X-ray diffraction by the (111) plane of austenitic iron gives the diffraction beams whose half-value width (2θ) is greater than 0.5 degree, and subsequently performing heat treatment in an atmosphere in which the partial pressure of oxygen is low, thereby forming an oxide film composed mainly of chromium oxide which has a thickness greater than 200 Å and a surface roughness $R_{max}$ smaller than 1 μm.

DESCRIPTION OF THE PREFERRED EMBODIMENTS

The essence of the present invention resides in the fact that if austenitic stainless steel is to have improved corrosion resistance to corrosive gases such as halogen gases, it is necessary that the surface of stainless steel have an oxide film of certain thickness which is composed mainly of chromium oxide. It was found that if such an oxide film is to be formed at a comparatively low temperature within a comparatively short time in an atmosphere in which the partial pressure of oxygen is low, it is essential that prior to oxidation the surface of stainless steel be mechanically polished with abrasive grains to such an extent that the surface has a work-strained layer formed therein which is characterized by that X-ray diffraction by the (111) plane of austenitic iron gives the diffraction beams whose half-value width (2θ) is greater than 0.5 degree. The present invention is based on this finding.

The present inventors investigated the corrosion resistance of stainless steel in chlorine gas by using a sample prepared by surface-polishing stainless steel in various manners and heating it at 400°–900° C. in an atmosphere in which the partial pressure of oxygen is from 760 to $10^{-6}$, thereby forming an oxide film. As the result, it was found that if the surface polishing which precedes the oxidation is carried to such an extent that the surface has a work-strained layer formed therein which is characterized by that X-ray diffraction by the (111) plane of austenitic iron gives the diffraction beams whose half-value width (2θ) is greater than 0.5 degree, then the stainless steel is coated with a highly corrosion-resistant film composed mainly of chromium oxide when it is heated in an atmosphere in which the partial pressure of oxygen is from $10^0$ to $10^{-3}$ Torr.

Figure 1:
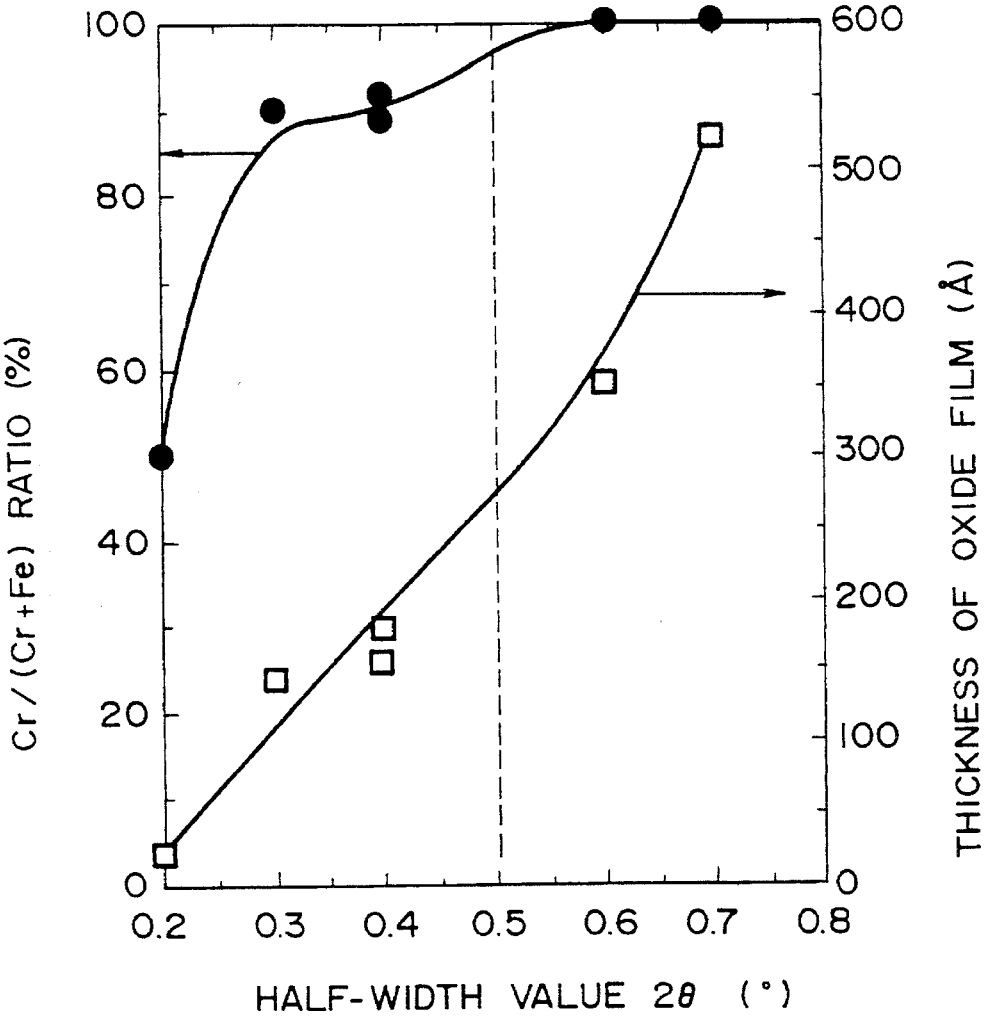
FIG. 1 is a graph showing how the half-value width of austenitic iron spectrum (after the surface polishing) relates to the Cr/(Cr+Fe) atomic ratio in the oxide film formed by oxidation and the thickness of the oxide film.

FIG. 1 graphically shows how the half-value width (after the surface polishing) relates to the Cr/(Cr+Fe) atomic ratio in the oxide film formed by oxidation and the thickness of the oxide film. It is noted that it is possible to form a thick Cr-rich oxide film having high corrosion resistance only if the half-value width is greater than 0.5 degree.

According to the present invention, the work-strained layer which meets the requirement for the half-value width as mentioned above should be formed by mechanically polishing the surface of stainless steel with abrasive grains having particle diameters of 1–10 μm. Such mechanical polishing creates an extremely fine crystalline structure in the surface layer, which accelerates the diffusion of chromium atoms to the surface during the subsequent oxidation step, thereby forming an oxide film composed mainly of chromium oxide. If the surface polishing mentioned above is replaced by pickling, electropolishing, or chemical polishing, which does not form a work-strained layer on the surface, the oxide film composed mainly of chromium oxide is not formed in the subsequent oxidation step. Therefore, it is impossible to achieve the outstanding corrosion resistance intended in the present invention. Of course, it is possible to form the work-strained layer on the surface by the mechanical polishing after pickling, electropolishing, or chemical polishing.

According to the present invention, the mechanical polishing should be carried out using abrasive grains having particle diameters of 1–10 μm. Mechanical polishing with abrasive grains having particle diameters smaller than 1 μm merely forms a layer of extremely fine crystals which is too thin to accelerate the diffusion of chromium atoms. This results in a very thin oxide film (composed mainly of chromium oxide) which is formed on the surface of stainless steel after heat treatment. Thus the stainless steel is subject to pitting corrosion in halogen gases. Therefore, the abrasive grains should have particle diameters larger than 1 μm, preferably larger than 4 μm. The coarser the abrasive grains used, the thicker the resulting layer of extremely fine crystals, and the thick layer accelerates more the diffusion of chromium atoms. The layer formed by using abrasive grains having particle diameters up to 10 μm provides improved corrosion resistance. Excessively coarse abrasive grains yield a rough surface which is poor in the gas releasing characteristics required of the gas piping of semiconductor manufacturing apparatus. Therefore, the abrasive grains should have particle diameters not more than 10 μm, preferably not more than 8 μm.

Figure 2:
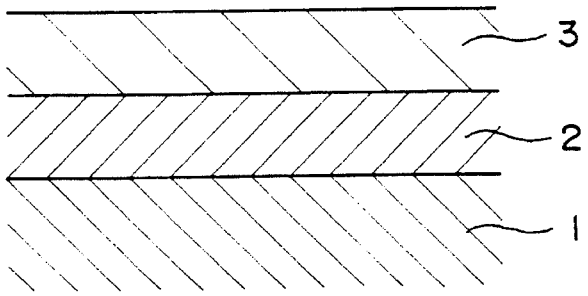
FIG. 2 is a schematic representation showing the surface layer structure of the surface-treated component obtained by the process of the present invention.

FIG. 2 schematically shows the surface layer structure of the surface-treated component obtained by the process of the present invention. There are shown a substrate metal (stainless steel) (1), a layer of extremely fine crystals (2), and an oxide layer (3) composed mainly of chromium oxide which is formed by the oxidation step. Presumably, this layer structure is responsible for the outstanding corrosion resistance to highly corrosive halogen gases.

The abrasive grains are not specifically limited in kind. Any one used for precision grinding can be used. Their common examples include diamond grains, $Al_2O_3$ grains, and SiC grains.

The above-mentioned mechanical polishing with abrasive grains having a specific particle diameter forms on the surface of stainless steel a work-strained layer which is characterized by the half-value width (2θ) greater than 0.5 degree. The subsequent heat treatment in an atmosphere in which the partial pressure of oxygen is low forms an oxide film at a comparatively low temperature of about 500°–700° C. The oxide film is composed mainly of chromium oxide. It exhibits outstanding corrosion resistance to chlorine gas etc. (This oxide film contains chromium in such an amount that chromium accounts for more than80 atom% of the metal elements in it, because chromium atoms diffuse to the surface during oxidation.) The probable reason for this is that the mechanical polishing forms on the surface of stainless steel a work-strained film which accelerates the diffusion of chromium atoms and the surface layer of extremely fine crystals (so-called Beilby layer) also accelerates the diffusion of chromium atoms which is predominantly intercrystalline diffusion at low temperatures.

The present invention requires that the oxide film composed mainly of chromium oxide be thicker than 200 Å, preferably thicker than 300 Å; otherwise, it will not exhibit sufficient corrosion resistance due to pinholes and other defects. The present invention also requires that the oxide film have a surface roughness $R_{max}$ lower than 1 μm; otherwise, it will be poor in the moisture vapor or other gases releasing characteristics which are required of semiconductor manufacturing apparatus. This requirement will be easily met by carrying out before oxidation the mechanical polishing with abrasive grains having particle diameters smaller than 10 μm.

The present invention requires that the oxide film have a thickness greater than 200 Å and be composed mainly of chromium oxide (such that chromium accounts for more than 80 atom% of the metal elements therein). This requirement is met by the above-mentioned condition that "the half-value width (2θ) is greater than 0.5 degree". So long as this requirement is met, there are no restrictions on the conditions under which the oxidation is carried out. For the Cr-rich oxide film to be formed efficiently, the oxidation should be carried out at about 500°–700° C. for 0.5–10 hours in an atmosphere in which the pressure is about$10^0$ to $10^{-4}$ Torr.

If the pressure is lower than about $10^{-4}$ Torr, the oxide film will not form readily at400°–900° C. and the oxide film thicker than 200 Å will take a very long time to form. By contrast, if the pressure is higher than about$10^0$ Torr, the oxide film will form rapidly but it is an Fe-rich one. In other words, under such conditions it is difficult to obtain the Cr-rich corrosion-resistant film intended in the present invention.

If the heating temperature is lower than about 500° C., the oxide film will take a long time to grow in an atmosphere in which the partial pressure of oxygen is low. On the other hand, if the heating temperature is higher than about 700° C., the oxide film grows rapidly but it has pinholes due to coarse structure which deteriorate corrosion resistance. Heating should be continued for more than about 30 minutes under the above-mentioned conditions to form a dense oxide film having an adequate thickness. However, heating for more than 10 hours is not practical for efficient operation. It is concluded from the foregoing that oxidation should be carried out at 500°–600° C. for 1–2 hours in an atmosphere in which the pressure is $10^{-2}$ to $10^{-3}$ Torr.

Figure 3:
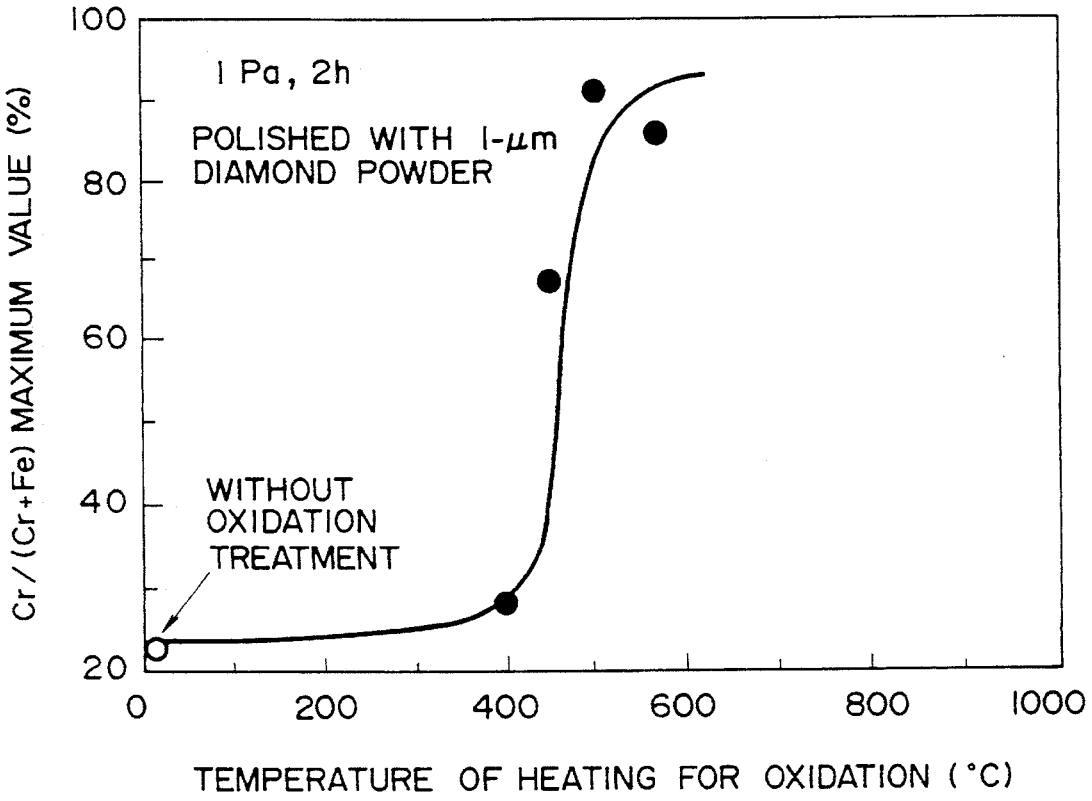
FIG. 3 is a graph showing the relationship between the heating temperature in oxidation (after mechanical polishing) and the Cr/(Cr+Fe) atomic ratio in the oxide film.

FIG. 3 shows how the maximum value of the Cr/(Cr+Fe) atomic ratio in the oxide film varies when oxidation is performed at varied temperatures on a stainless steel component which has undergone mechanical polishing with diamond abrasive grains finer than 1 μm. Incidentally, the oxidation is done in a vacuum in which the pressure is $10^{-2}$ Torr. It is apparent from FIG. 3 that the Cr content in the oxide film greatly varies according as the heating temperature increases. It is noted that oxidation at higher than about 500° C. yields oxide films in which chromium accounts for more than 80% of metal elements. However, the chromium content levels off at heating temperatures beyond about 700° C. At excessively high heating temperatures, the oxide film forms so rapidly that it includes pinholes which deteriorate corrosion resistance.

Figure 4:
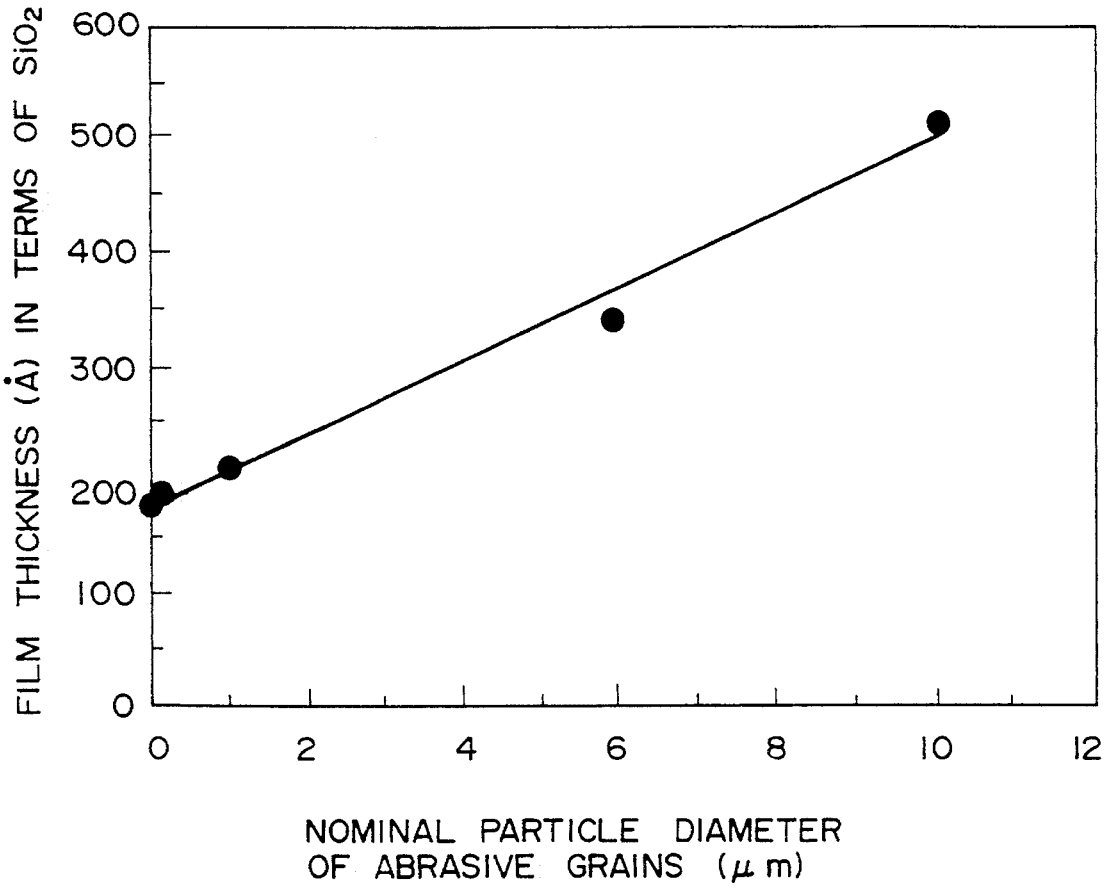
FIG. 4 is a graph showing the relationship between the particle diameter of abrasive grains used for mechanical polishing and the thickness of the oxide film formed by the subsequent heat-oxidation.

FIG. 4 shows the relationship between the thickness of the oxide film (in terms of $SiO_2$) and the nominal particle diameter of diamond abrasive grains used. The oxide film was formed by heating at 500° C. for 2 hours in an atmosphere in which the pressure is $10^{-3}$ Torr, after mechanical polishing with diamond abrasive grains. It is noted from FIG. 4 that the oxide film increases in thickness with the increasing particle diameter of the diamond abrasive grains. It is thus noted that it is possible to form oxide films thicker than 200 Å by using abrasive grains coarser than 1 μm. However, abrasive grains coarser than 10 μm give rise to an oxide film having a surface roughness $R_{max}$ in excess of 1 μm. Such an oxide film is subject to adsorption and desorption of moisture vapor and other gases, which is unfit for the purpose of the present invention.

EXAMPLES

The following examples are included merely to aid in the understanding of the invention, and variations may be made by one skilled in the art without departing from the spirit and scope of the invention.

Examples and Comparative Examples

Surface polishing and heat oxidation were performed under the conditions shown in Table 1 on a commercial Type 316L sheet (bright annealed: 17% Cr, 12.1% Ni, 2.1% Mo). Mechanical polishing was carried out by the wet mechanical method using SiC waterproof abrasive paper, alumina abrasive grains, or diamond abrasive grains. Electropolishing was carried out with a mixed solution of phosphoric acid, sulfuric acid, and oxalic acid. The surface layer formed by polishing was examined by thin-film X-ray diffractometry (with an incident angle of 1° ) for the half-value width (2θ) due to the (111) plane of austenitic iron. The results are shown in Table 1.

Subsequently, the sample was heated in an atmosphere in which the partial pressure of oxygen is low so as to form an oxide film on the polished surface. This heat oxidation was carried out using a stainless steel vacuum heating furnace, with the atmosphere therein so controlled as to establish a desired partial pressure of oxygen by means of a oxygen-nitrogen mixture gas and a vacuum pump. The thus obtained oxide film was examined for film thickness, surface roughness, and Cr/(Cr+Fe) atomic ratio. It was also tested for corrosion resistance under the following conditions. The results are shown in Table 1. Method for evaluating corrosion resistance:

The oxidized sample was exposed to a 5% $Cl_2$ atmosphere at 250° C. for 4 hours. Corrosion resistance was rated by measuring the depth (Å) of chlorine attack by means of Auger electron spectroscopy.

TABLE 1

| Experiment No. | | Abrasive grains or polishing method | Average particle diameter of abrasive grains (μm) | Half-value width of austenitic iron spectrum (degree) | Heating conditions: Degree of vacuum (Torr) | Heating conditions: Temperature (°C.) | Heating conditions: Heating time (hours) | Film thickness (Å) | Surface roughness $R_{max}$ (μm) | Cr/(Cr + Fe) atomic ratio | Depth of attack by chlorine |
|---|---|---|---|---|---|---|---|---|---|---|---|
| Example | 1 | Alumina | 1 | 0.6 | $10^{-2}$ | 500 | 2 | 210 | 0.3 | 0.92 | <10 |
| | 2 | Diamond | 1 | 0.5 | $10^{-3}$ | 550 | 0.5 | 230 | 0.3 | 0.90 | <10 |
| | 3 | Diamond | 6 | 0.8 | $10^{-1}$ | 700 | 1 | 480 | 0.3 | 0.88 | <10 |
| | 4 | SiC | 10 | 1.2 | $10^{0}$ | 600 | 1 | 320 | 0.7 | 0.86 | <10 |
| | 5 | Alumina | 6 | 0.7 | $10^{-4}$ | 650 | 1 | 370 | 0.3 | 0.91 | <10 |
| Comparative Example | 6 | Alumina | 0.06 | 0.2 | $10^{-2}$ | 500 | 2 | 150 | 0.2 | 0.90 | 30 |
| | 7 | Diamond | 0.5 | 0.3 | $10^{1}$ | 550 | 1 | 250 | 0.3 | 0.65 | 50 |
| | 8 | Alumina | 1 | 0.6 | $7.6 \times 10^{2}$ | 600 | 0.5 | 400 | 0.3 | 0.30 | 70 |
| | 9 | SiC | 10 | 1.0 | $10^{0}$ | 750 | 1 | 550 | 0.8 | 0.70 | 40 |
| | 10 | SiC | 40 | 1.2 | $10^{-2}$ | 500 | 2 | 550 | 2.5 | 0.90 | <10 |
| | 11 | Electrolytic | — | 0.2 | $10^{-2}$ | 550 | 2 | 30 | 0.3 | 0.55 | 120 |
| | 12 | As rolled | — | 0.2 | $10^{-3}$ | 500 | 10 | 35 | 2.5 | 0.30 | 150 |

The following are noted from Table 1.

Nos. 1 to 5. These experiments meet the requirements of the present invention. In these experiments, mechanical polishing results in the half-value width (2θ) greater than 0.5°. The oxide film is rich in chromium, has an adequate thickness, and exhibits outstanding corrosion resistance. In addition, the oxide film has a surface roughness ($R_{max}$) lower than 1 μm. It hardly adsorbs and desorbs moisture vapor and gases. These properties make the sample suitable for use as components of semiconductor manufacturing apparatus.

By contrast, comparative samples in experiments Nos. 6 to 12, which do not meet the requirements of the present invention, involve problems with corrosion resistance and surface roughness.

No. 6. Mechanical polishing with excessively fine abrasive grains resulted in a polished surface whose austenitic iron spectrum has a half-value width lower than 0.5 degree. Due to insufficient work strain, the oxide film is not thick enough to provide satisfactory corrosion resistance.

No. 7. The polished surface, which gave a half-value width lower than 0.5 degree, was heated in an atmosphere in which the partial pressure of oxygen is high to form an oxide film. The resulting oxide film does not contain sufficient chromium required for good corrosion resistance.

No. 8. Mechanical polishing was carried out so that the resulting surface gives a half-value width greater than 0.5 degree. However, the subsequent oxidation was carried out in an atmosphere in which the partial pressure of oxygen is high, so that the resulting oxide film does not contain sufficient chromium required for good corrosion resistance.

No. 9. Mechanical polishing was carried out using coarse abrasive grains having an average particle diameter greater than 10 μm. Oxidation was carried out under adequate conditions and the resulting oxide film has an adequate thickness for high corrosion resistance. However, the oxide film has such a high surface roughness that it is subject to gas adsorption and desorption. Therefore, it is not suitable for use as components of semiconductor manufacturing apparatus. Nos. 11 and 12. The oxide film was formed without mechanical polishing or after electropolishing. Since the surface layer has a low half-value width (2θ) and is not given work strain, it was difficult to form the oxide film. In addition, the resulting oxide does not contain sufficient chromium required for good corrosion resistance. The sample in No. 12 is not suitable for semiconductor manufacturing apparatus because of its high surface roughness.

[Effect of the invention]

As mentioned above, the process of the present invention consists of mechanically polishing the surface of stainless steel with abrasive grains having a specific particle diameter, thereby applying work strain to the surface, and subsequently heating the stainless steel in an atmosphere in which the partial pressure of oxygen is low, thereby forming on the surface of stainless steel an oxide film composed mainly of chromium oxide. The surface treatment in this manner provides outstanding corrosion resistance to halogen gases and lower the adsorption and desorption of moisture vapor and gases. Thus the surface-treated stainless steel is suitable for use as components of semiconductor manufacturing apparatus.

What is claimed is:

1. A process for surface treatment of stainless steel for semiconductor manufacturing apparatus, said process comprising mechanically polishing the surface of a stainless steel component with abrasive grains having particle diameters of 1–10 μm to such an extent that the surface has a work-strained layer formed therein which is characterized by that X-ray diffraction by the (111) plane of austenitic iron gives the diffraction beams whose half-value width (2Θ) is greater than 0.5 degree, and subsequently performing heat treatment in an atmosphere in which the partial pressure of oxygen is low, thereby forming an oxide film composed mainly of chromium oxide which has a thickness greater than 200 Å and a surface roughness $R_{max}$ smaller than 1 μm, wherein the heat treatment for oxidation is carried out under the condition that the pressure is $10^{0}$–$10^{-4}$ Torr, the heating temperature is 500°–700° C., and the heating time is 0.5– 10 hours.

2. A process for surface treatment as defined in claim 1, wherein the particle diameters of abrasive grains are 4–8 μm.

3. A process for surface treatment as defined in claim 1 or 2, wherein the abrasive grains are those which are selected from the group consisting of diamond grains, $Al_2O_3$ grains, and SiC grains.

4. A process for surface treatment as defined in claim 1, wherein the heat treatment for oxidation is carried out under the condition that the pressure is $10^{-2}$–$10^{-3}$ Torr, the heating temperature is 500°–600° C., and the heating time is 1–3 hours.

5. A process for surface treatment as defined in claim 1, wherein the oxide film is composed of chromium oxide such that chromium atoms account for more than 80 atom % of metal elements contained therein.

6. A process for surface treatment as defined in claim 1, wherein the oxide film has a thickness greater than 300 Å.

7. A process for surface treatment as defined in claim 1, wherein the stainless steel is Type 304L or Type 316L.

8. A process for surface treatment as defined in claim 1, wherein the oxide film is one which exhibits outstanding corrosion resistance to halogen gases.

* * * * *

UNITED STATES PATENT AND TRADEMARK OFFICE

CERTIFICATE OF CORRECTION

PATENT NO. : 5,456,768

DATED : October 10, 1995

INVENTOR(S) : Haruo TOMARI, et al.

It is certified that error appears in the above-indentified patent and that said Letters Patent is hereby corrected as shown below:

On the title page, Item [75], the second inventor's name should read:

--Ikuro Hashimoto--

Signed and Sealed this

Twelfth Day of December, 1995

*Attest:*

*Attesting Officer*

Bruce Lehman

BRUCE LEHMAN

*Commissioner of Patents and Trademarks*